US008127462B2

(12) United States Patent
Haurie et al.

(10) Patent No.: US 8,127,462 B2
(45) Date of Patent: Mar. 6, 2012

(54) CYLINDRICAL DRYER HAVING CONDUITS PROVIDED WITHIN A PLURALITY OF HOLDING PLATES

(76) Inventors: Osvaldo Ricardo Haurie, Boenos Aires (AR); Richard Kenneth Haurie, Alexandria, VA (US)

( * ) Notice: Subject to any disclaimer, the term of this patent is extended or adjusted under 35 U.S.C. 154(b) by 325 days.

(21) Appl. No.: 12/591,126

(22) Filed: Nov. 9, 2009

(65) Prior Publication Data

US 2010/0126033 A1 May 27, 2010

(51) Int. Cl.
*F26B 11/02* (2006.01)

(52) U.S. Cl. ..... 34/117; 34/124; 34/138; 162/358.9; 165/83; 165/90; 219/471; 100/328; 100/335

(58) Field of Classification Search ..... 34/90, 110, 34/117, 119, 124, 138.168, 80; 162/358.9; 100/328, 335; 219/471; 165/83, 90
See application file for complete search history.

(56) References Cited

U.S. PATENT DOCUMENTS

| | | | | | |
|---|---|---|---|---|---|
| 1,675,274 | A | | 6/1928 | Miller | 165/89 |
| 2,193,141 | A | | 3/1940 | Price | 237/2 |
| 2,316,669 | A | * | 4/1943 | Busi | 68/20 |
| 2,357,251 | A | | 8/1944 | Behr | 122/44.1 |
| 2,365,271 | A | * | 12/1944 | Hornbostel | 165/278 |
| 2,405,532 | A | * | 8/1946 | Todd | 422/53 |
| 2,413,567 | A | * | 12/1946 | Hornbostel | 34/124 |
| 2,452,858 | A | * | 11/1948 | Miller | 264/605 |
| 2,563,692 | A | | 8/1951 | Ostertag et al. | 165/89 |
| 2,568,891 | A | | 9/1951 | Walter | 261/140.1 |
| 2,576,036 | A | | 11/1951 | Ostertag et al. | 165/89 |
| 2,577,243 | A | | 12/1951 | Gunther | |
| 2,586,829 | A | * | 2/1952 | Kelsey | 34/124 |
| 2,725,640 | A | | 12/1955 | Voigtman | 162/111 |
| 2,817,908 | A | | 12/1957 | Lloyd | 34/110 |
| 2,833,526 | A | | 5/1958 | Otten et al. | 165/163 |

(Continued)

FOREIGN PATENT DOCUMENTS

DE 4012419 A1 * 10/1991

(Continued)

*Primary Examiner* — Stephen M. Gravini
(74) *Attorney, Agent, or Firm* — Welsh Flaxman & Gitler LLC

(57) ABSTRACT

A dryer uses conduits to carry a heating medium, such as steam, to heat the outer surface of the dryer. The volume of steam is successfully reduced to non-explosive levels and the shell need not be designed to prevent an explosion. Conduits may be formed through the shell itself or grooves may be formed on the inner surface of the shell, with the conduits retained within the grooves. Also, the conduits can be placed against the inside surface of the dryer and a material, such as zinc, can be filled in about the conduits. The material serves to both retain the conduits in place and thermally couple the conduits to the dryer to assure efficient heat transfer between the conduits and dryer. These modifications relieve the dryer from the Unfired Pressure Vessel classification to the classification of a piping assembly under ASA code regulations. This results in savings in operation safety, installation cost and operating costs due to the absence of costly inspections. Transportation costs are lowered by manufacturing a plurality of holding plates which would be transported to the location of use at which point the Yankee dryer will be constructed. It is contemplated that the plurality of holding plates would not require a shell surrounding the exterior of these holding plates. Additionally, the thermal gradient on the exterior of the Yankee dryer will be controlled through the use of a plurality of auxiliary supply and exhaust conduits.

9 Claims, 11 Drawing Sheets

U.S. PATENT DOCUMENTS

| | | | | | |
|---|---|---|---|---|---|
| 2,844,887 | A | | 7/1958 | Lloyd | 34/119 |
| 2,869,248 | A | * | 1/1959 | Justus | 34/568 |
| 2,893,136 | A | | 7/1959 | Justus et al. | 34/119 |
| 2,909,849 | A | | 10/1959 | Hornbostel | |
| 2,915,293 | A | | 12/1959 | Daane et al. | 165/88 |
| 2,920,874 | A | | 1/1960 | Gardner | 165/40 |
| 2,924,273 | A | * | 2/1960 | Conley et al. | 159/12 |
| 3,022,047 | A | | 2/1962 | Swaney | 165/89 |
| 3,052,039 | A | | 9/1962 | Johnson | 34/110 |
| 3,060,592 | A | | 10/1962 | Ostertag, Jr. | 34/124 |
| 3,061,944 | A | | 11/1962 | Kraus et al. | 34/110 |
| 3,097,933 | A | | 7/1963 | Kellogg et al. | 34/454 |
| 3,099,543 | A | | 7/1963 | Malmstrom et al. | 34/124 |
| 3,116,985 | A | | 1/1964 | Kraus | 34/110 |
| 3,118,743 | A | | 1/1964 | Malmstrom et al. | 34/110 |
| 3,169,050 | A | | 2/1965 | Kroon | 34/124 |
| 3,177,932 | A | | 4/1965 | Smith, Jr. | 165/88 |
| 3,181,605 | A | | 5/1965 | Smith, Jr. | 165/90 |
| RE25,927 | E | | 12/1965 | Justus et al. | 165/89 |
| 3,224,110 | A | | 12/1965 | Kroon | 34/124 |
| 3,228,462 | A | | 1/1966 | Smith, Jr. | 165/89 |
| 3,241,251 | A | | 3/1966 | Justus et al. | 34/124 |
| 3,258,851 | A | | 7/1966 | Vonderau | 34/124 |
| 3,264,754 | A | | 8/1966 | Kutchera | 34/124 |
| 3,299,530 | A | | 1/1967 | Eiss et at | 34/124 |
| 3,359,647 | A | | 12/1967 | Webb | 34/124 |
| 3,367,042 | A | | 2/1968 | Cox, Jr. | 34/124 |
| 3,382,584 | A | * | 5/1968 | Blake et al. | 34/292 |
| 3,447,247 | A | | 6/1969 | Daane | 34/122 |
| 3,465,727 | A | | 9/1969 | Tidball | 122/32 |
| 3,473,238 | A | | 10/1969 | Spraker, Jr. et al. | 34/125 |
| 3,481,050 | A | | 12/1969 | Cox, Jr. | 34/124 |
| 3,513,565 | A | | 5/1970 | Jacobson | 34/125 |
| 3,576,078 | A | | 4/1971 | Holt | 34/454 |
| 3,633,662 | A | | 1/1972 | Voll | 165/89 |
| 3,640,000 | A | | 2/1972 | Lee et al. | 34/125 |
| 3,680,627 | A | | 8/1972 | Linning | 165/162 |
| 3,721,016 | A | | 3/1973 | Lee et al. | 34/125 |
| 3,724,094 | A | | 4/1973 | Appel et al. | 34/124 |
| 3,808,700 | A | | 5/1974 | Kraus | 34/124 |
| 3,812,907 | A | | 5/1974 | Linning | 165/83 |
| 3,911,595 | A | | 10/1975 | Lande | 34/110 |
| 3,917,516 | A | * | 11/1975 | Waldmann et al. | 202/227 |
| 3,981,084 | A | | 9/1976 | Sobota | 34/123 |
| 4,050,900 | A | * | 9/1977 | Hobbs et al. | 422/605 |
| 4,146,361 | A | | 3/1979 | Cirrito | 432/60 |
| 4,163,688 | A | | 8/1979 | Kankaanpaa | 162/359.1 |
| 4,185,399 | A | | 1/1980 | Gladish | 34/120 |
| 4,235,284 | A | | 11/1980 | Coleman | 165/141 |
| 4,324,613 | A | | 4/1982 | Wahren | 162/111 |
| 4,384,412 | A | | 5/1983 | Chance et al. | 34/119 |
| 4,447,964 | A | | 5/1984 | Gardner | 34/452 |
| 4,688,335 | A | | 8/1987 | Krill et al. | 34/273 |
| 4,710,272 | A | | 12/1987 | Passarelli et al. | 202/205 |
| 4,878,299 | A | | 11/1989 | Wedel | 34/513 |
| 4,882,851 | A | * | 11/1989 | Wennerstrum et al. | 34/60 |
| 4,955,268 | A | | 9/1990 | Ickinger et al. | |
| 5,090,135 | A | | 2/1992 | Wolf et al. | 34/124 |
| 5,165,471 | A | * | 11/1992 | Atsumi | 165/89 |
| 5,263,267 | A | * | 11/1993 | Buttner et al. | 34/519 |
| 5,335,427 | A | | 8/1994 | Partio | 34/119 |
| 5,437,107 | A | | 8/1995 | Ensign et al. | 34/117 |
| 5,445,216 | A | | 8/1995 | Cannata | 165/88 |
| 5,553,391 | A | | 9/1996 | Bakalar | 34/110 |
| 5,566,473 | A | | 10/1996 | Salminen | |
| 5,575,084 | A | | 11/1996 | Vuorinen | |
| 5,588,223 | A | | 12/1996 | Marshall | 34/414 |
| 5,899,264 | A | * | 5/1999 | Marschke | 165/89 |
| 5,966,835 | A | | 10/1999 | Bakalar | 34/267 |
| 6,032,725 | A | * | 3/2000 | Marschke et al. | 165/90 |
| 6,079,116 | A | | 6/2000 | Jewitt et al. | 34/115 |
| 6,161,302 | A | | 12/2000 | Rantala | 34/119 |
| 6,405,790 | B1 | | 6/2002 | van Haag | 165/90 |
| 6,560,893 | B1 | | 5/2003 | Bakalar | 34/110 |
| 6,694,639 | B2 | | 2/2004 | Hanaya | 34/115 |
| 6,790,315 | B2 | | 9/2004 | Klerelid | 162/117 |
| 6,877,246 | B1 | | 4/2005 | Hada et al. | 34/119 |
| 7,143,525 | B2 | | 12/2006 | Hada et al. | 34/121 |
| 7,540,944 | B2 | | 6/2009 | Bitterly et al. | 203/22 |
| 7,610,768 | B2 | * | 11/2009 | Lubman et al. | 62/238.6 |
| 7,614,161 | B2 | * | 11/2009 | Haurie et al. | 34/117 |
| 2002/0179269 | A1 | | 12/2002 | Klerelid | 162/206 |
| 2003/0019125 | A1 | | 1/2003 | Hanaya | 34/114 |
| 2004/0149405 | A1 | | 8/2004 | Beck | 162/115 |
| 2005/0138832 | A1 | | 6/2005 | Hada et al. | 34/122 |
| 2005/0262720 | A1 | * | 12/2005 | Rane et al. | 34/330 |
| 2006/0179677 | A1 | | 8/2006 | Timm et al. | 34/114 |
| 2007/0051009 | A1 | | 3/2007 | Hada et al. | 34/114 |
| 2007/0107884 | A1 | | 5/2007 | Sirkar et al. | 165/114 |
| 2007/0245588 | A1 | * | 10/2007 | Haurie et al. | 34/114 |
| 2007/0289156 | A1 | | 12/2007 | Kloibhofer et al. | 34/119 |
| 2008/0005921 | A1 | | 1/2008 | Gruber-Nadlinger et al. | 34/108 |
| 2010/0126033 | A1 | * | 5/2010 | Haurie et al. | 34/114 |

FOREIGN PATENT DOCUMENTS

| | | | | |
|---|---|---|---|---|
| DE | 4342294 | A1 | * | 6/1995 |
| DE | 10225075 | A1 | * | 11/2003 |
| EP | 96605 | A1 | * | 12/1983 |
| EP | 1675274 | A1 | | 6/2006 |
| EP | 2101057 | A1 | * | 9/2009 |
| JP | 63141606 | A | * | 6/1988 |
| JP | 03244789 | A | * | 10/1991 |
| JP | 2001003812 | A | * | 1/2001 |

* cited by examiner

CYLINDRICAL DRYER HAVING CONDUITS PROVIDED WITHIN A PLURALITY OF HOLDING PLATES

CROSS-REFERENCE TO RELATED APPLICATIONS

This application claims benefit of provisional patent application Ser. No. 60/793,657, filed Apr. 21, 2006, and claims the priority of U.S. patent application Ser. No. 11/785,614, filed Apr. 19, 2007.

FIELD OF THE INVENTION

The present invention is directed to the field of cylindrical dryers generally used in the papermaking industry.

BACKGROUND OF THE INVENTION

Cylindrical dryers are used in the paper making process. Webs of paper are passed over heated cylindrical drums to remove moisture from the web. The large cylindrical dryers, often referred to as "Yankee Dryers," must be continuously heated to maintain an elevated temperature during the paper making process.

One type of Yankee dryer has an inner and outer shell. The space created between the inner and outer shell is fed with a heating medium, such as steam under pressure, to heat the outer surface of the dryer. The dryers are commonly made out of cast iron. A double shelled cast iron dryer is difficult to cast, costly and extremely heavy. Double shelled dryers were very rare and the idea was abandoned early.

Another type of Yankee dryer has a closed cylinder with pressurized steam fed into the cylinder. The pressurized steam raises the possibility of catastrophic explosion when the cylinder fails under the pressure. One possible solution to explosion risks in a pressurized cylinder type Yankee dryer is to fill the volume within the cylinder with spheres. Spheres occupy space within the cylinder and reduces the amount of pressurized steam. This reduced amount of pressurized steam lowers the risk of explosions. Problems with this approach include the need to use a non-compressible material for the spheres, increasing the weight of the dryer. Also, with spheres of equal size the total volume cannot be reduced more than approximately two thirds. This reduction is not enough for the purposes of reducing the amount of steam.

SUMMARY OF THE INVENTION

A dryer uses conduits to carry a heating medium, such as steam, to heat the outer surface of the dryer. The volume of steam is successfully reduced to non-explosive levels and the shell need not be designed to prevent an explosion. Conduits may be formed through the shell itself or grooves may be formed on the inner surface of the shell, with the conduits retained within the grooves. Also, the conduits can be placed against the inside surface of the dryer and a material, such as zinc, can be filled in about the conduits. The material serves to both retain the conduits in place and thermally couple the conduits to the dryer to assure efficient heat transfer between the conduits and dryer. These modifications relieve the dryer from the Unfired Pressure Vessel classification to the classification of a piping assembly under ASA code regulations. This results in savings in operation safety, installation cost and operating costs due to the absence of costly inspections.

Generally, the Yankee dryers which are described in one embodiment of the present invention are very bulky and heavy. These Yankee dryers include a plurality of conduits extending from one end of the cylindrical Yankee dryer to the other end of the Yankee dryer. These conduits are generally inserted into grooves in a holding plate. When steam is passed through these grooves, an outer shell surrounding the holding plates would be heated through conduction. Since the completed Yankee dryer is very heavy and bulky, it is quite difficult and expensive to transport the completed Yankee dryer from a first location to a second location. Typically, the Yankee dryers would be manufactured at the first location then transported to a paper mill or other facility at the second location. The approximate cost of transporting the Yankee dryer from, for example, Minnesota to Miami would be about $1,000,000. The present invention makes it much easier and less expensive to transport the Yankee dryer in a multitude of parts, instead of a single finished Yankee dryer constructed from cat iron or other metallic materials. For example, a plurality of separate holding plates would be manufactured and then transported from the first location to the second location utilizing standard containers. These containers are easily transported from the first location to the second location at a savings of cost of 80-90% when compared to shipping the completed Yankee dryer from the first location to the second location. These holding plates are then attached to one another to produce the cylindrical Yankee dryer at the second location.

Additionally, since this application describes a Yankee dryer whose interior are open at both ends and therefore not pressurized, an outer shell as previously as illustrated with respect to FIG. 10 would not be necessary. In this embodiment, the holding plate 54 in FIG. 10 would be greater in thickness, such as between three and four inches in the present embodiment. This particular holding plate would allow, along with the fact that the interior of the Yankee dryer would not be pressurized, to eliminate the outer shell shown in FIG. 10.

Yet another embodiment would control the thermal gradient along the length of the holding plates from the first end of the Yankee dryer to the second end of the Yankee dryer. This control of the thermal gradient could occur in both the embodiment which includes the outer shell illustrated in FIG. 10, or the embodiment which does not include the outer shell. This is possible since the Yankee dryer of the present invention is not sealed at both ends, preventing a buildup of condensation and pressure. A central supply/exhaust conduit or conduits would extend from one end of the Yankee dryer to the second end of the Yankee dryer and supply steam to the plurality of conduits. This central supply/exhaust conduit would generally traverse the central portion of the Yankee dryer from the first end to the second end. A plurality of auxiliary supply and exhaust conduits would extend from the central supply/exhaust conduit to the conduits embedded in or attached to the holding plates. Pressure control valves associated with the auxiliary supply and exhaust conduits would control the pressure and speed of the steam flowing to and away from the conduits associated with the holding plates. The entire length of the Yankee dryer could be divided into two or more zones. The auxiliary supply and exhaust conduits would supply steam to, and remove steam from, the conduits in each of the zones, thereby controlling the thermal gradient on the exterior surface of the shell and the holding plates. Generally, the flow of the steam through the auxiliary supply conduits would be dictated based upon the environment in which the Yankee dryer would operate. Once a proper thermal gradient is established, it is contemplated that the valves would not open and close to change the thermal gradient. However, it is contemplated that the opening and closing of these valves can be programmed by the user.

DETAILED DESCRIPTION OF THE INVENTION

Figure 1:
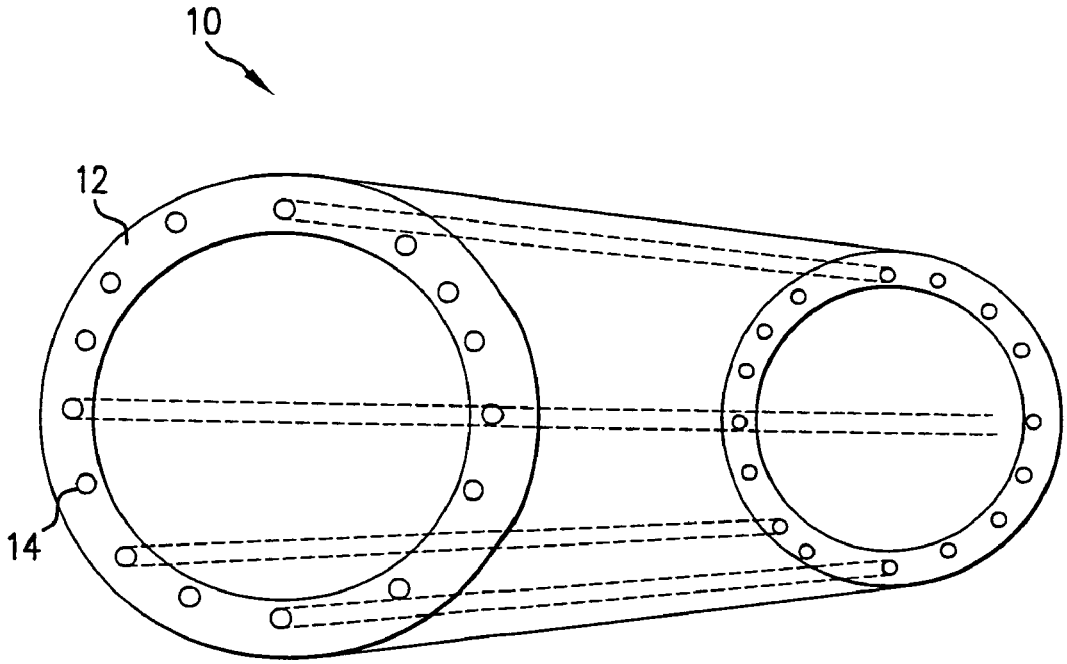
FIG. 1 shows a perspective view of shells having conduits formed within the shell.

FIG. 1 shows a dryer 10 formed by a single shell 12 with a series of conduits 14 running along the length of the dryer. The dryer 10 is made of any suitable material, such as cast iron or stainless steel. These conduits 14 continuously carry a heating medium, such as steam, to heat the outside surface of the dryer, over which the paper web passes. By forming conduits within the shell, heat transfer occurs about the entire perimeter of the conduit, affording a maximum heat transfer surface. By way of example, a shell having a ¾ inch thickness can have conduits ¼ inch in diameter. The number of conduits is limited to maintain the shell's integrity.

Figure 2:
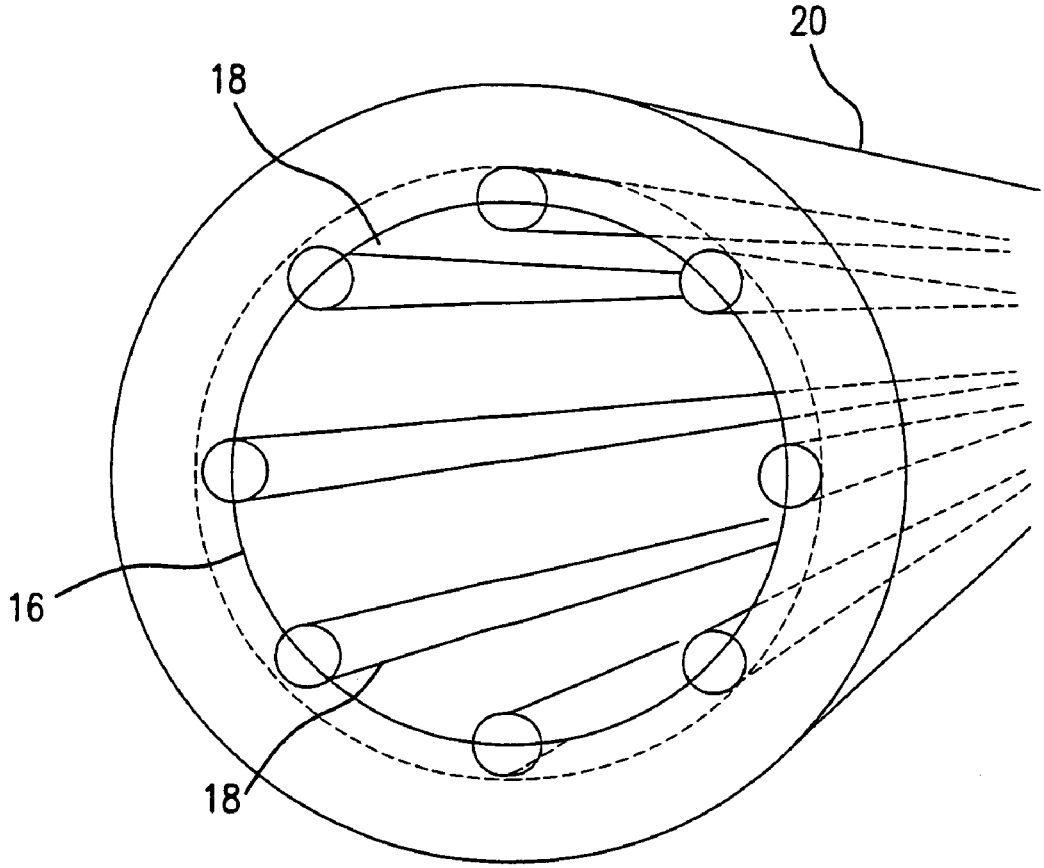
FIG. 2 shows an end perspective view of a shell having conduits on the inner surface.

An alternative arrangement shown in FIG. 2 forms grooves within the inner surface 16 of the shell and places conduits 18 within the groove. The grooves can have a depth equal to half the diameter of the conduits. A conduit inserted to a depth equal to its radius and placed side-to-side offers an increase of 54% in heat transfer surface of the inside surface 16 of the dryer. Conduits are often spaced from one another, not place side-to-side, reducing the 54% increase in surface area of the inner surface but enough conduits are used to effectively heat the outside surface 20 of the dryer.

Figure 3:
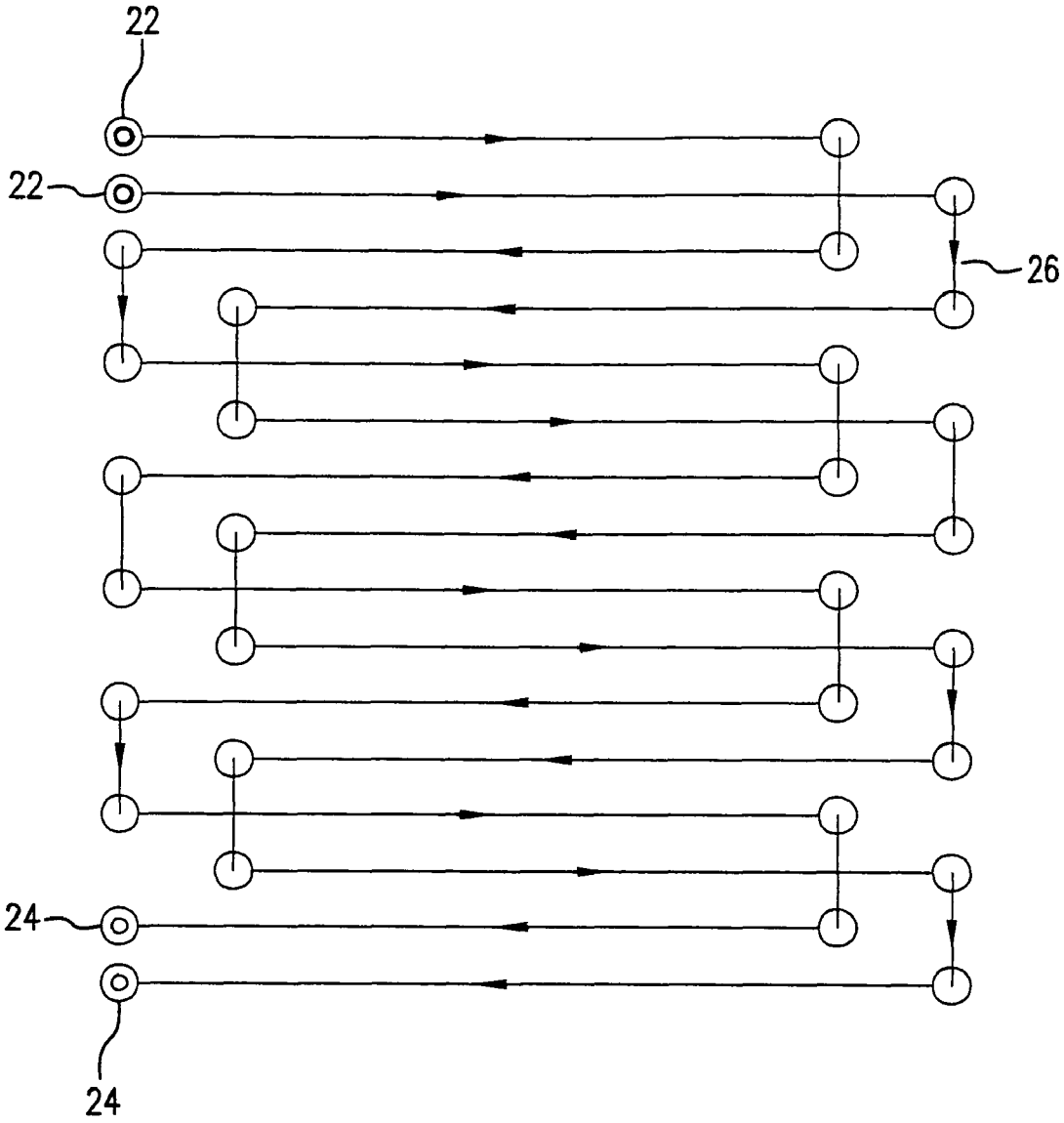
FIG. 3 shows a flow path for the conduits.

FIG. 3 shows a schematic diagram of the heating medium flow through the conduits. In this view, the left and right side of the dryer are represented on the left and right sides of the diagram. The layout is as if the dryer has been split along its length and been flattened, so that the inner surface of the dryer is visible. In this arrangement, two inlets 22 and two outlets 24 are used to establish two parallel flows of heating medium. The heating medium enters through the inlet, travels the entire length of the dryer through the conduit and then connects to another conduit through a riser 26 and flows back to the left side. This process is repeated as the heating medium moves back and forth across the length of the dryer until it reaches the outlet 24. While two parallel flows are shown, it is understood that any number of inlets and outlets may be used and the outlets may be on the end opposite of the inlet.

Figure 4A:
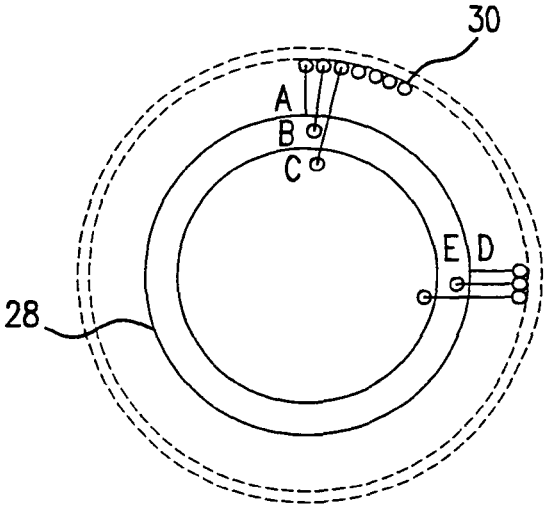
FIGS. 4*a* and 4*b* shows end and side views of an alternative arrangement for providing steam to conduits.
Figure 4B:
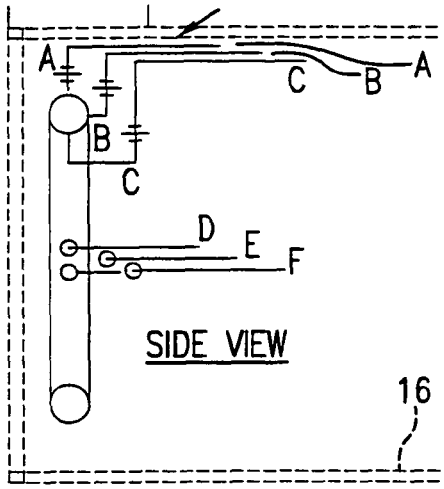

FIG. 4*a* shows an alternative arrangement, providing each conduit with an inlet and outlet for steam. This arrangement can be used when using iron pipes and offers easier assembly and maintenance. A circular header 28 providing steam has a series of conduits 30 attached thereto. As seen in FIG. 4*b*, the conduits 30 are attached to the top, side and bottom surfaces of the circular header 28 allowing a greater number of ports without sacrificing the structural integrity of the header. Each conduit 30 receives heating medium from the header and connects to a similar header at the opposite end of the dryer as an outlet.

Figure 5:
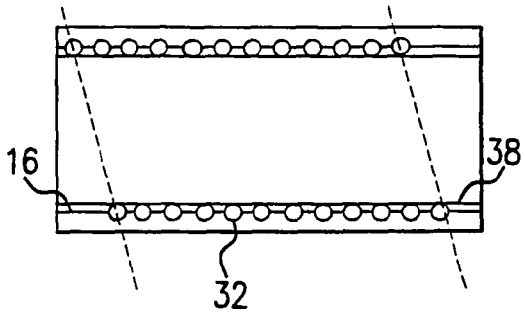
FIG. 5 shows a side cross-sectional view of coiled conduits on the inner surface of a shell.

FIG. 5 shows a view of a dryer having a helically arranged tube 32 extending the length of the dryer. Again, the tube may be inserted in grooves having a depth equal to the radius of the tube. One advantage of the helical arranged coils is that, upon heating, the helix expands, further securing the tubes within the groove. Conduits placed against the inner surface 16 the dryer may be embedded in a filler material such as zinc to create a new inner surface 38. The conduits can be completely embedded but this is not necessary. The material thermally and mechanically couples the conduit to the dryer. This process requires no machining of the dryer and ensures a high rate of thermal transfer from the steam to the outside surface 40 of the dryer. This process can be retrofitted to existing dryers, regardless of the shell thickness and used with axially extending tubes, as well as a helically extending tube.

Figure 6:
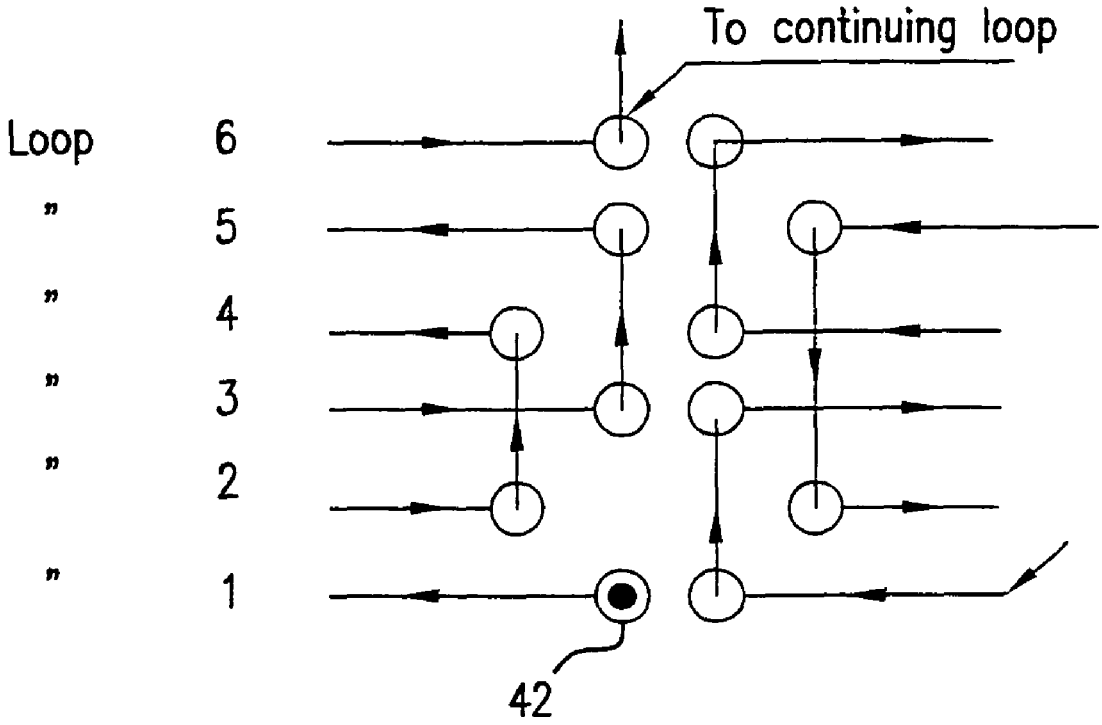
FIG. 6 shows a flow diagram for steam through the loop arrangement.

FIG. 6 shows the movement of steam, or other heating medium, through loops. Starting with the steam supply 42, the steam extends through the first loop, connects to the third loop. After completion of the three loops, steam is transferred to the fifth loop. As seen in the drawings, when complete with the fifth loop, steam is returned to the second loop through a conduit. Upon completion of the second loop, steam travels to the fourth loop and, finally, to the sixth loop.

Figure 7:
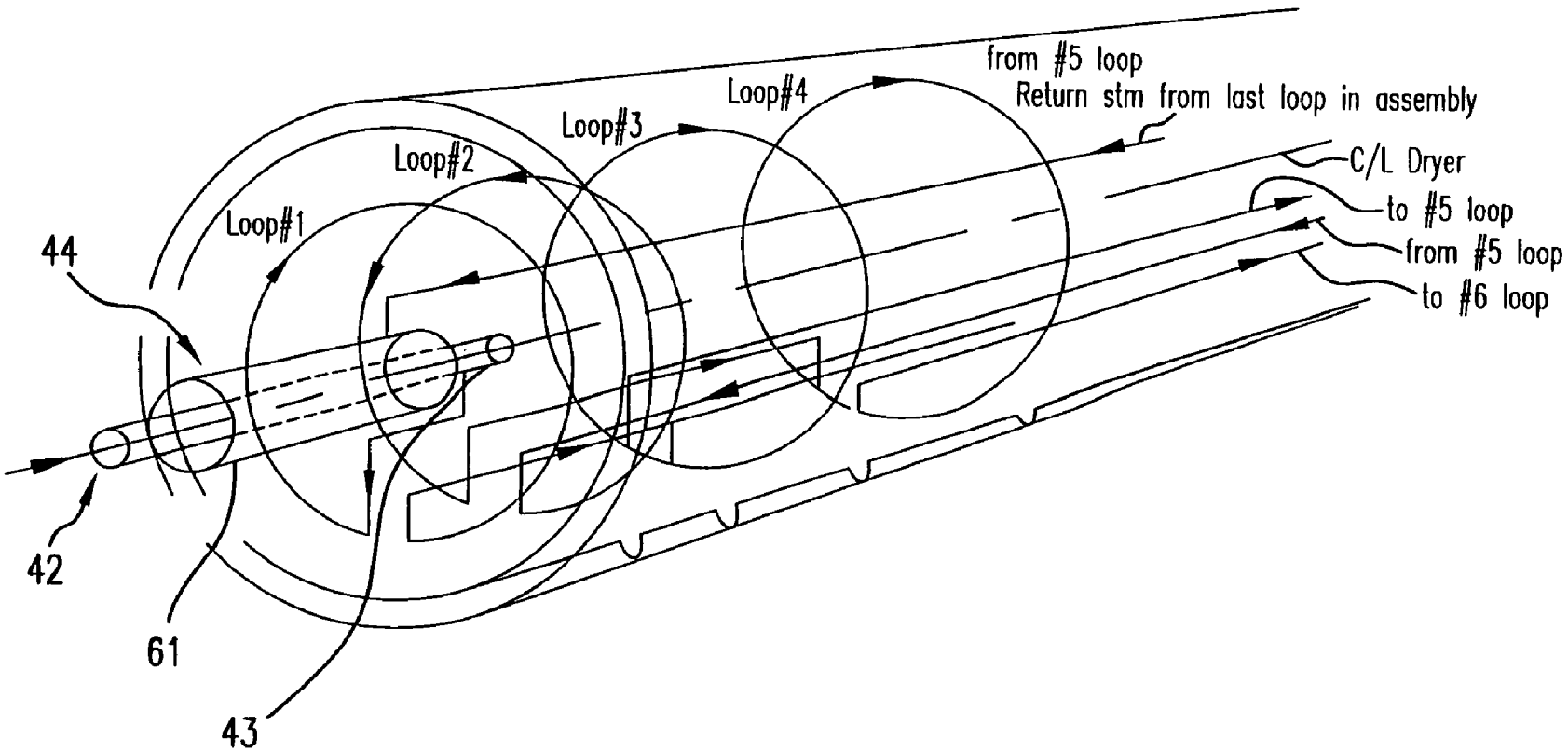
FIG. 7 is a perspective view of the flow path of steam through loops.

FIG. 7 shows this path in a three-dimensional perspective view with loops one through four shown for purposes of clarity. Also seen in FIG. 7 is the concentric steam supply 42 and outlet 44. The inner tube 43, having a length greater than the outer tube 61, carries the inlet steam with the outer, larger and shorter tube, serving as the outlet for exhaust steam.

Figure 8:
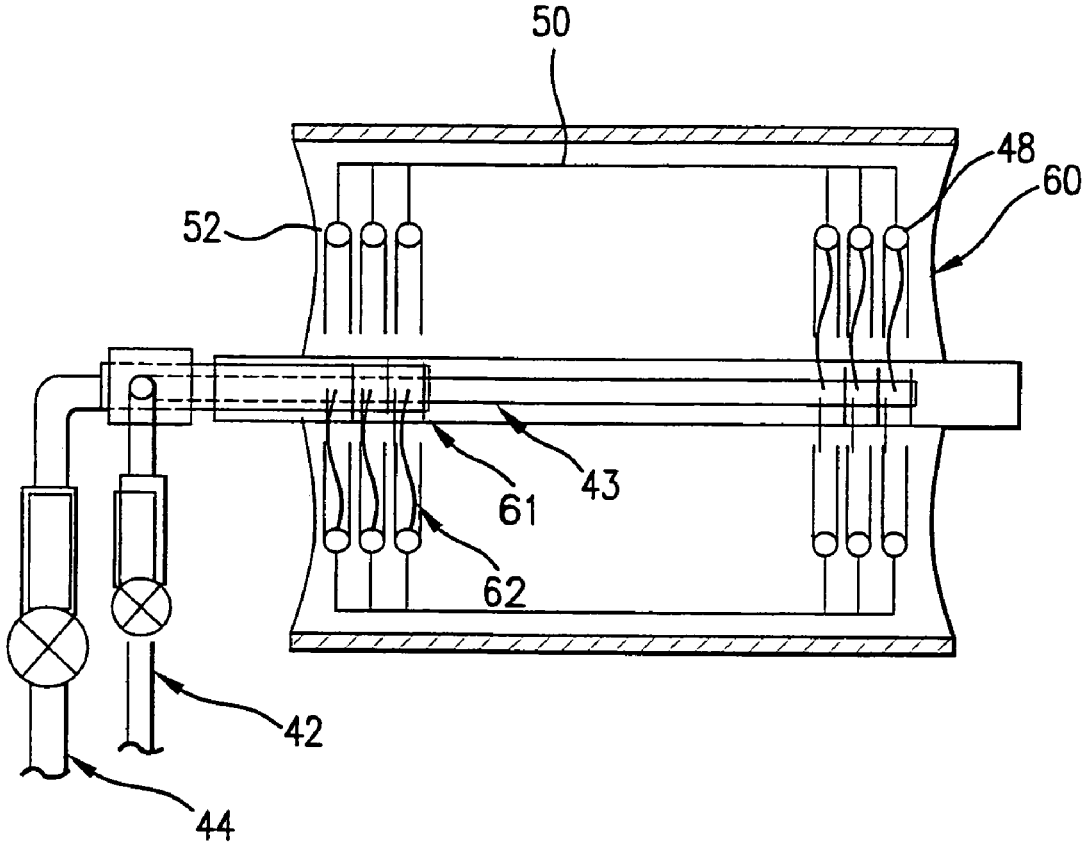
FIG. 8 is a side cross-sectional view of an alternative arrangement for providing steam through a heat transfer tube.
Figure 9:
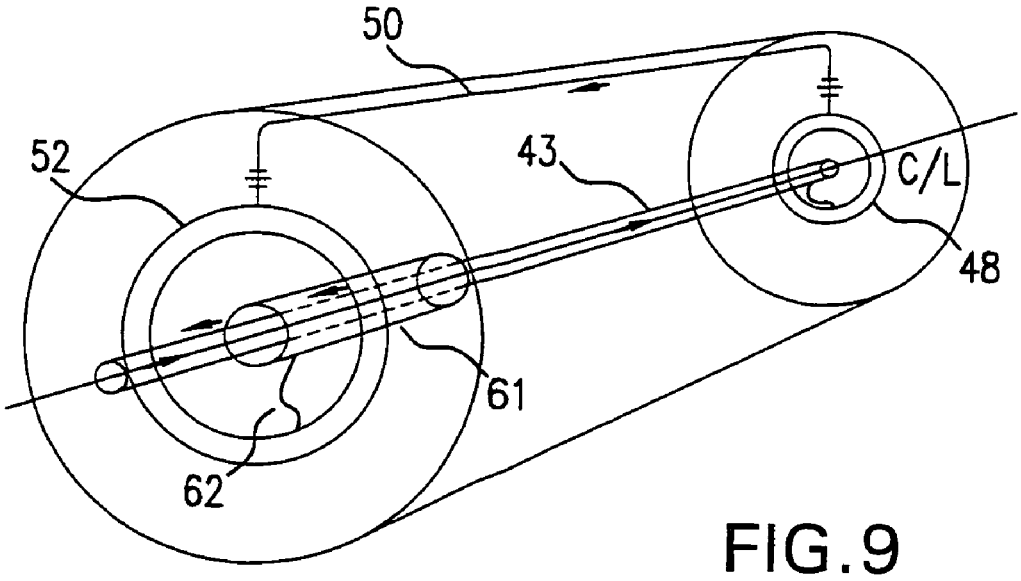
FIG. 9 is a perspective view of the arrangement of FIG. 9.

FIG. 8 shows an arrangement using the concentric steam supply and return. In this arrangement, the steam supply stem 43 extends the entire length of the dryer and feeds a series of floating ring headers 48 by steam hoses 60. Heat transfer tubes 50 receive the steam from the headers and are connected to exhaust return steam ring headers 52 which, in turn, connect to the outer steam return 61 by steam hoses 62. The arrangement is also clearly seen in FIG. 9, which uses a single steam supply 46 and exhaust return steam ring headers 52.

Figure 10:
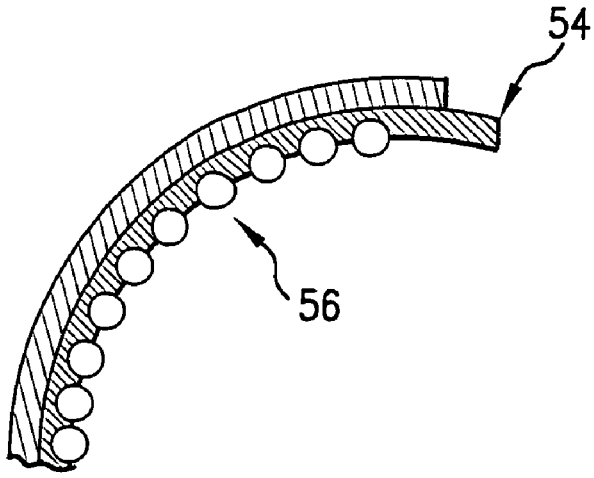
FIG. 10 is a cross sectional view of a shell having a holding plate.

FIG. 10 is a cross section view of a shell using a holding plate 54 to which conduits 56 are attached. To facilitate assembly of new dryers or the retrofitting of existing dryers, the conduits are first attached to the holding plate 54 and then the holding plate to attached to the inner surface of the dryer. An advantage of this arrangement is the ability to use several holding plates to cover the interior surface of the dryer.

The use of conduits on the inner surface of a dryer shell allows higher pressure steam to be used. Existing dryers can be retrofit with grooves and conduits at little cost. The system has a longer life span and less down time than prior yankee dryers leading to great savings for the manufacturing plants.

Figure 11:
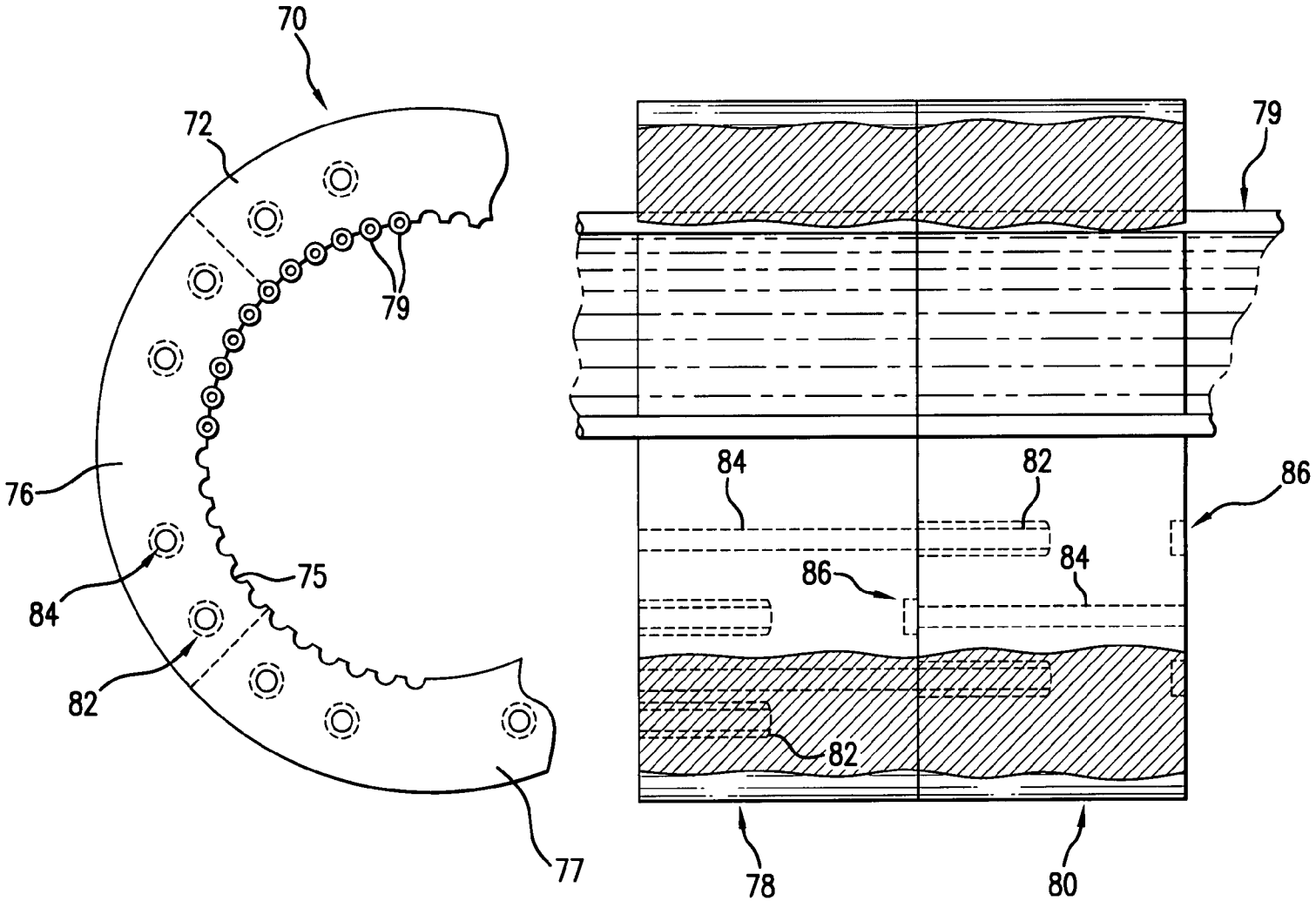
FIG. 11 is a partial cross-sectional view of several of the holding plates during the construction of the entire Yankee dryer.

FIG. 11 illustrates the additional embodiment in which the holding plate 54 is replaced by a plurality of radially and longitudinally extending holding plates which are secured among themselves to offer the ability to provide the functionality of a Yankee dryer without the outer cylindrical shell. Therefore, in this instance, the holding plates themselves can comprise the Yankee dryer. As previously mentioned, the prior art Yankee dryers are constructed utilizing a single-piece cylinder fabricated from either cast iron or welded rolled sheet metal, or a similar substance. The present invention utilizing a plurality of holding plates manufactured at a first location would allow the transportation of these plurality of holding plates to the installation site at a great savings in cost.

Once the plurality of holding plates and other implements are shipped from the first location to the installation location, the Yankee dryer, according to the present invention would then be built. For example, as shown in FIG. 11, a portion of the Yankee dryer 70 is shown with a plurality of holding plate segments 72, 74, 76 and 77. Since a cylindrically shaped Yankee dryer will be produced, a plurality of holding plate segments such as shown as 72 and 76 would be radially provided to form a portion of a first ring of a plurality of holding plate segments. Although not shown in FIG. 11, additional holding plate segments will be provided to form a single ring containing a plurality of holding plate segments. Additional rings would be longitudinally provided along the length of the Yankee dryer to produce the entire cylindrical Yankee dryer. Each inner surface of the rings such as ring 76 would be provided with a plurality of grooves 75 into which a plurality of longitudinal conduits such as 79 will be inserted after the entire cylindrical Yankee dryer has been constructed. One or more torsion rings would be attached to the inner surface of the holding plates to maintain the plurality of conduits in place over the length of the Yankee dryer. The holding plate segments forming a first ring would be offset with respect to the holding plate segments in front and behind of that ring. For example, holding plate members 74 and 77 would be provided behind the holding plate rings formed with holding plate segment 72 and 76.

The manner in which holding plate segments are secured to one another is also shown in FIG. 11. As shown therein, a plurality of through holes 84 are provided and would line up with respective threaded holes 82 shown with respect to holding plate members 78 and 80. A recess 86 is provided allowing an appropriate bolt (not shown) to connect one of the holding plate members to a second longitudinally affixed offset holding plate member. Generally, bolts from one holding plate member would be inserted into two offset holding plate members. Finally, as shown in FIG. 11, once all of the holding plate members are bolted together, the plurality of conduits 79 would be inserted into the grooves 75. Steam would flow through these conduits 79 and, through conduction, the exterior surface of the holding member segments would be heated to provide an external drying surface, without the use of the cylindrical shell shown in FIG. 10. Since the holding plate segments are aligned in a brick laying pattern, the bolts would provide both longitudinal and radial support.

Figure 12:
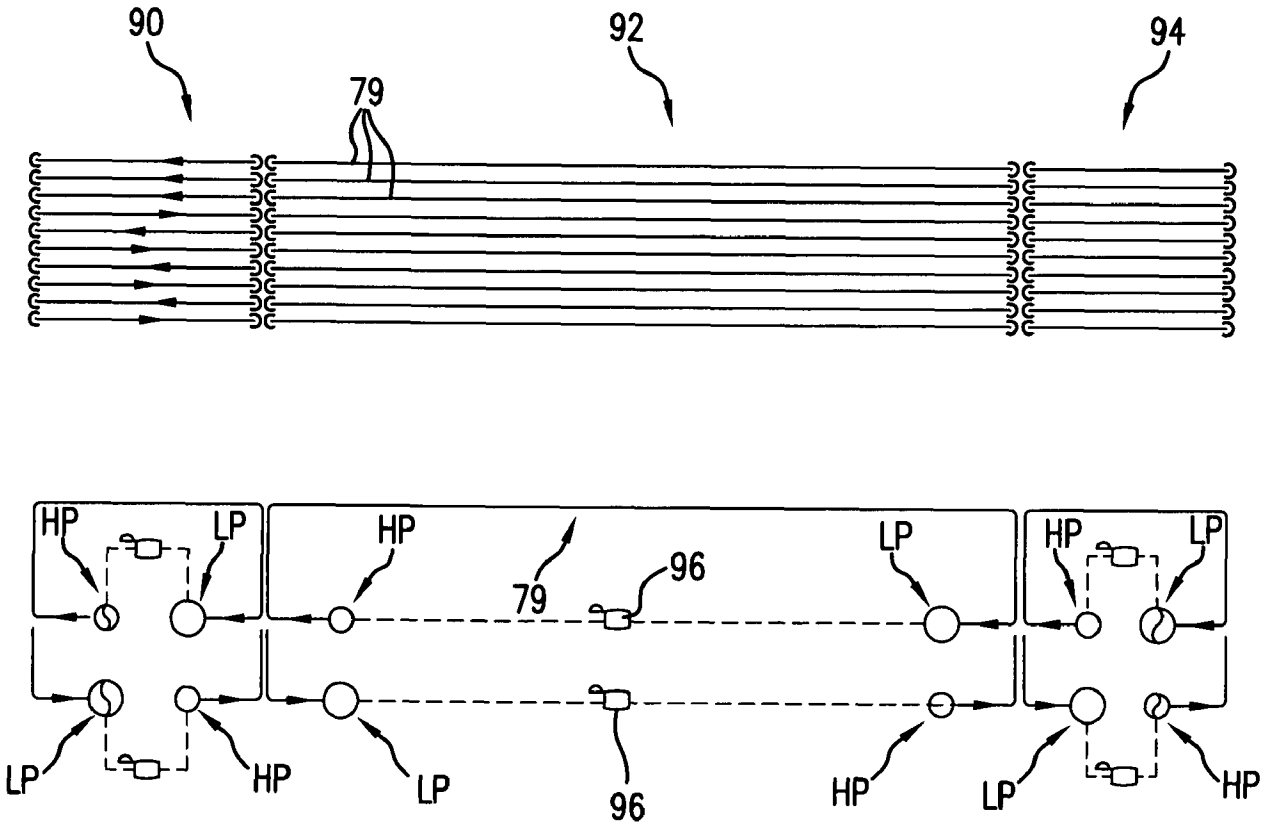
FIG. 12 is a view showing the manner in which the heating gradients across the heating conduits can be buried.
Figure 13:
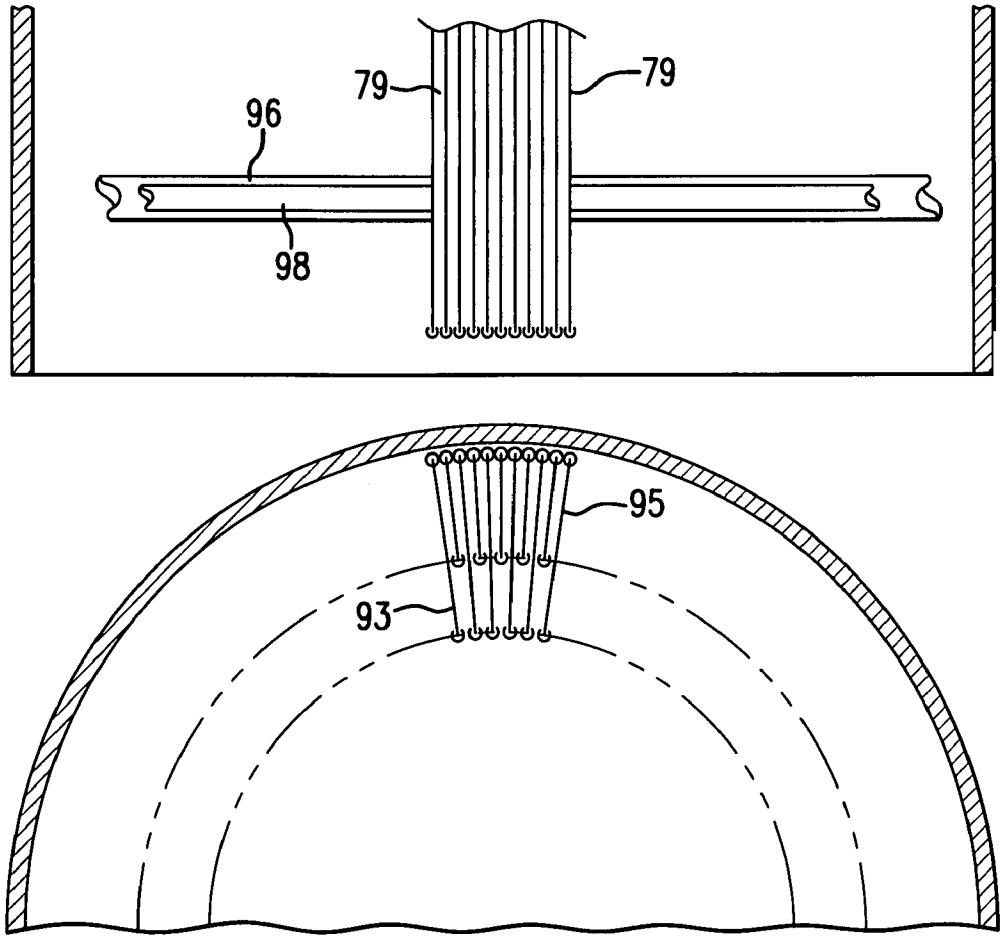
FIG. 13 illustrates the connection between the heating conduits and a supply and exhaust tube.

FIGS. 12 and 13 illustrate the manner in which a cross dryer thermal gradient is provided on the exterior surface of the holding plates of the Yankee dryer. This is important due to various factors during the paper production process in which the temperature on the external surface of the holding plate members would vary, for example, due to various environmental consideration. Additionally, if it is noted that several regions on the exterior surface of the holding plate members are moist, therefore more difficult to produce the paper, the temperature in these regions can be altered. For example, as shown in FIGS. 12 and 13, the conduits 79 have been defined to contain three zones, 90, 92 and 94 over the entire length of the conduits 79. Additionally, it is noted as shown in FIG. 12 that steam flowing in adjacent conduits, flow in the opposite direction from one another. Although FIG. 12 shows the utilization of three zones, it can be appreciated that more zones can be applied.

As illustrated in FIG. 13, a supply conduit 96 extends through the interior of the Yankee dryer from one end to the other end. Similarly, an exhaust conduit 98 would also extend from one end of the Yankee dryer to the other end next to the supply conduit. The supply conduit is connected to a source of steam which is directed into the supply conduit. Each zone can be customized to control the thermal profile of the individual cylinders 79 in their operational environment. This customization can be accomplished by both varying the area covered by each zone as well as the speed and pressure of the heating medium, such as steam flowing within the conduit 79 using standard differential pressure controllers 96. Two controllers 96 are provided for each of the zones 90, 92 and 94 thereby providing both high pressure and low pressure throughout the zones. As previously indicated, flow through adjacent conduits 79 is in the opposite direction provided for even feed distribution. Furthermore, the number of zones needed is determined by how many areas of the cylinder need their thermal characteristics addressed separately. The heating medium, such as steam flowing within the conduits 79 of each zone has its own pressure and flow characteristics controlled in order to alleviate uneven drying across the cylinder due to environmental, fabrication and materials factor.

The pressure controllers would control the pressure and speed of the steam which would flow from the supply conduit 96 into the plurality of conduits 79 affixed to each of the holding plate members. This is accomplished through a plurality of auxiliary supply conduits 93 supplying the steam from the supply conduit 96 to the conduits 79. Similarly, exhaust from the conduit 79 would be directed through a plurality or of auxiliary conduits 95 to be received in the main exhaust conduit 98. The differential pressure valves are connected to a main control grid, allowing automatic, programmable and mechanical operation of these controllers.

The external surface of the plurality of holding plates would be coated with a metallic coating currently applied to current Yankee dryers to extend their operational life as well as the organic coatings used in the paper production, thereby providing the exact same contact surface in Yankee dryers currently in use. After a period of time, the metallic coating would begin to deteriorate. When this occurs, this metallic coating would be scraped from the external surface of the holding plate members and replaced with an additional metallic coating of approximately ½ millimeter in thickness. At this point, the organic coating would again be applied to the exterior surface of the metallic coating.

While the invention has been described with reference to preferred embodiments, variations and modifications would be apparent to one of ordinary skill in the art. The invention encompasses such variations and modifications.

What is claimed is:

1. A Yankee dryer, comprising:

an open ended cylindrical shell having an outer surface and an inner surface, said cylindrical shell provided with a first open end portion and a second open end portion, said cylindrical shell comprising a plurality of holding plate segments forming a radial first ring of holding plate segments, a plurality of fluid conduits in said dryer, said fluid conduits contacting said inner surface of said open ended cylindrical shell thereby heating said inner surface and said outer surface of cylindrical shell by conduction and a source of heating medium connected to said plurality of conduits;

wherein since said cylindrical shell is not sealed at both ends and no heating medium is provided outside of said conduits within said shell, no condensate is produced within said cylindrical shell outside of said plurality of conduits, and no buildup of pressure can occur within said shell outside of said plurality of conduits.

2. The dryer in accordance with claim 1, further including at least one second ring of holding plate segments, each holding plate segment of said first ring of holding plate segments connected to one holding plate segment of said second ring of holding plate segments.

3. The dryer in accordance with claim 2, when each of said holding plate segment of said first ring of holding plate segment is offset with respect to at least two holding plate segments of said second ring of holding plate segments.

4. The dryer in accordance with claim 2, further including a series of holding plate segment rings extending from said first open end portion to said second open end portion, thereby completing said open ended cylindrical shell.

5. The dryer in accordance with claim 3, further including a series of holding plate segment rings extending from said first open end portion to said second open end portion, thereby completing said open ended cylindrical shell.

6. The dryer in accordance with claim 1, wherein each of said plurality of fluid conduits contains a plurality of thermal zones of their length to provide a thermal gradient along the length of each of said fluid conduits.

7. The dryer in accordance with claim 6, wherein each of said plurality of fluid conduits is provided with at least one differential pressure controller, thereby creating a plurality of heating medium circuits within each of said conduits.

8. The dryer in accordance with claim 7, further including a plurality of grooves in said holding plates in which said plurality of conduits are tightly fitted which are utilized to control the contact pressure of said plurality of conduits within said plurality of grooves.

9. The dryer in accordance with claim 7, wherein each of said differential pressure controllers is independently controlled, thereby controlling the flow of said heating medium within said plurality of conduits.

* * * * *